United States Patent [19]

Dalton

[11] 4,085,892

[45] Apr. 25, 1978

[54] CONTINUOUSLY ENERGIZED ELECTROSTATIC COATING VOLTAGE BLOCK

[76] Inventor: Robert E. Dalton, 859 E. 169th St., South Holland, Ill. 60473

[21] Appl. No.: 678,862

[22] Filed: Apr. 21, 1976

[51] Int. Cl.[2] ..... B05B 5/02

[52] U.S. Cl. ..... 239/15; 239/127; 361/228

[58] Field of Search ..... 239/124, 127, 3, 15; 427/30–33; 118/627, 629; 204/220, 275, 279; 317/3; 222/56, 190

[56] References Cited

U.S. PATENT DOCUMENTS

| | | | |
|---|---|---|---|
| 2,692,798 | 10/1954 | Hicks | 239/127 X |
| 3,458,133 | 7/1969 | Wiggins | 239/127 X |
| 3,463,121 | 8/1969 | Walberg | 239/15 X |
| 3,621,815 | 11/1971 | Walberg | 239/15 X |
| 3,637,420 | 1/1972 | Walberg | 427/33 |
| 3,746,253 | 7/1973 | Walberg | 239/3 X |
| 3,774,844 | 11/1973 | Walberg | 239/15 |
| 3,870,233 | 3/1975 | Wilhelm et al. | 239/15 |
| 3,893,620 | 7/1975 | Rokadia | 239/15 X |
| 3,906,122 | 9/1975 | Krause et al. | 427/33 |
| 3,933,285 | 1/1976 | Wiggins | 239/3 X |

FOREIGN PATENT DOCUMENTS

| | | | |
|---|---|---|---|
| 1,444,054 | 5/1966 | France | 239/15 |

*Primary Examiner*—Joseph F. Peters, Jr.
*Assistant Examiner*—Michael Mar

[57] ABSTRACT

A continuously energized electrostatic spray coating system sends measured masses of highly conductive coating material across an insulating air space from a grounded pulser to a high voltage container. A series of such continuously energized voltage blocks have their output connected to a manifold which is alternately supplied paint from one of the voltage blocks by remote control.

9 Claims, 3 Drawing Figures

CONTINUOUSLY ENERGIZED ELECTROSTATIC COATING VOLTAGE BLOCK

BACKGROUND OF THE INVENTION

1. Field Of The Invention

The present invention relates to an electrostatic spray coating system and more particularly to electrostatic spray coating systems for applying conductive coating materials such as water base paints.

2. Description Of The Prior Art

In the past years the applicant of the invention herein described designed and placed on the market automatic electrostatic spray coating systems for spraying high conductive coatings such as porcelain enamel frit in a water carrier wherein the entire spray coating system including the entire supply system was electrically isolated from ground.

Such a system is disclosed in U.S. Pat. No. 3,463,121 issued Aug. 26, 1969, U.S. Pat. No. 3,621,815 issued Nov. 23, 1971, and U.S. Pat. No. 3,637,420 issued Jan. 25, 1972. Although such a system advanced the art, it could not have its main coating material supply reservoir filled while the high voltage was being applied to the system and it could not be utilized for manual spray systems for the operator would be touching components charged to the high voltage utilized in such systems.

Voltage blocks have been developed which consists of a jain supply source or first continaer which is used to fill a second container. A third container at high voltage receives conductive coating material from the second container at times when no material is flowing fro the first to the second container. These systems have the disadvantage that arcing will occur if insulated conduit is used between the first and second containers because of residual material on the conduit surfaces. Pouring from a transportation drum or container as the grounded first container eliminates this arcing, but there still remains three required sub-systems which are the first at ground, the second or intermediate alternately at ground or high voltage, and the third at high voltage. Further, these three container or three sub-system supply systems can not be utilized for manual electrostatic spray systems for the operator would be touching components charged to high voltage.

SUMMARY OF THE INVENTION

The present invention overcomes these difficulties by providing an electrostatic spray coating system wherein highly conductive spray coating material is transferred from a grounded container or circulating system across an air space to a high voltage supply sub-system which in turn delivers coating material which has now become highly charged to one or more electrostatic spray coating spray guns. The closest spacing between the two sub-systems and the intermediate masses of coating material are so adjusted that the high voltage is prevented from arcing across the air insulation space through the individual masses to the grounded supply sub-system.

It is therefore an object of the present invention to provide a new and improved spray coating system for spraying highly conductive coating material.

Another object is to provide an electrostatic spray coating system which has two coating supply sub-systems separated from each other by an air space through which masses of conductive coating materials are ejected, the masses being small enough in comparison to the air space to prevent arcing between the grounded sub-system and the high voltage supply sub-system.

An additional object is to provide a selected multicolor supply system having a voltage block for each color in the system wherein the high voltage components are all continuously charged to high voltage.

DESCRIPTION OF THE DRAWINGS

Further objects and advantages will become apparent from the following detailed description taken in connection with the accompanying drawings in which.

DESCRIPTION OF THE PREFERRED EMBODIMENT

While this invention is susceptible of embodiment in many different forms, there will be described herein in detail embodiments of the invention with the understanding that the present disclosures are to be considered as exemplifications of the principles of the invention and are not intended to limit the invention to the embodiments illustrated. The scope of the invention will be pointed out in the appended claims.

Figure 1:
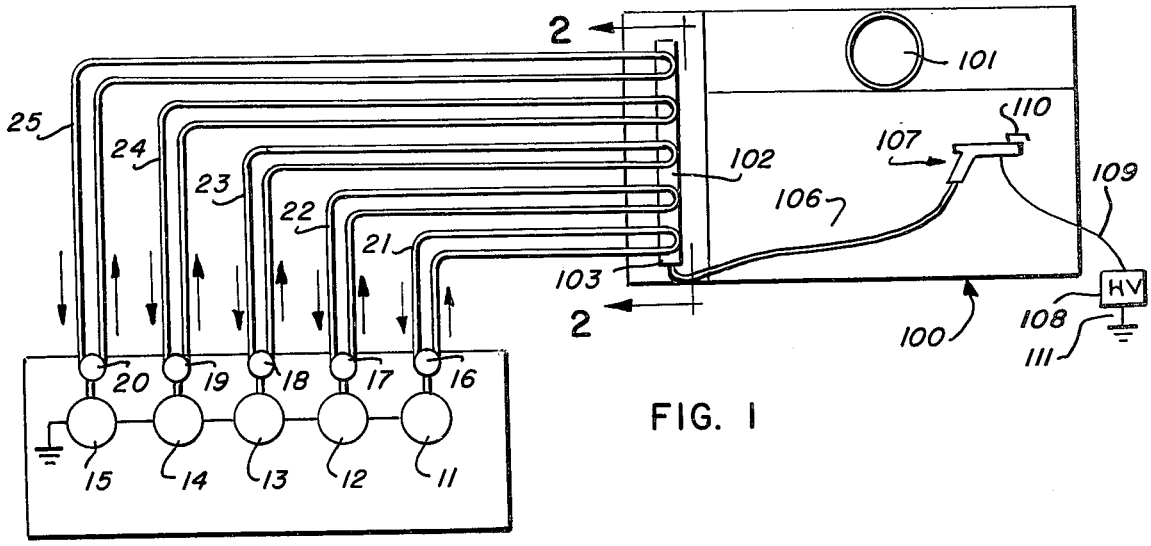
FIG. 1 is an overhead schematic drawing of an electrostatic spray coating system embodying the present invention.

Referring to FIG. 1 the paint supply and mix area 10 has five paint containers 11–15 mounted therein and electrically grounded. The containers may be tanks of any size which are compatible with the needs of a particular system. Each container has a pump 16–20 connected thereto to receive paint or other coating material. An electrically grounded paint circulating line 21–25 is connected to the output of each respective pump 16–20. When no paint is being removed from the respective lines 21–25 the pumps 16–20 continuously circulate paint through the lines. When paint is being removed from the lines the respective pump replenishes the paint in the line from the respective containers 11–15. In a typical operation, tanks 11–14 and therefore lines 21–24 respectively each contain a difficult color of highly conductive paint or coating material. Container 15 and therefore line 25 contains a paint solvent. The pumps 16–20 are of any suitable design well known to those skilled in the art.

Figure 2:
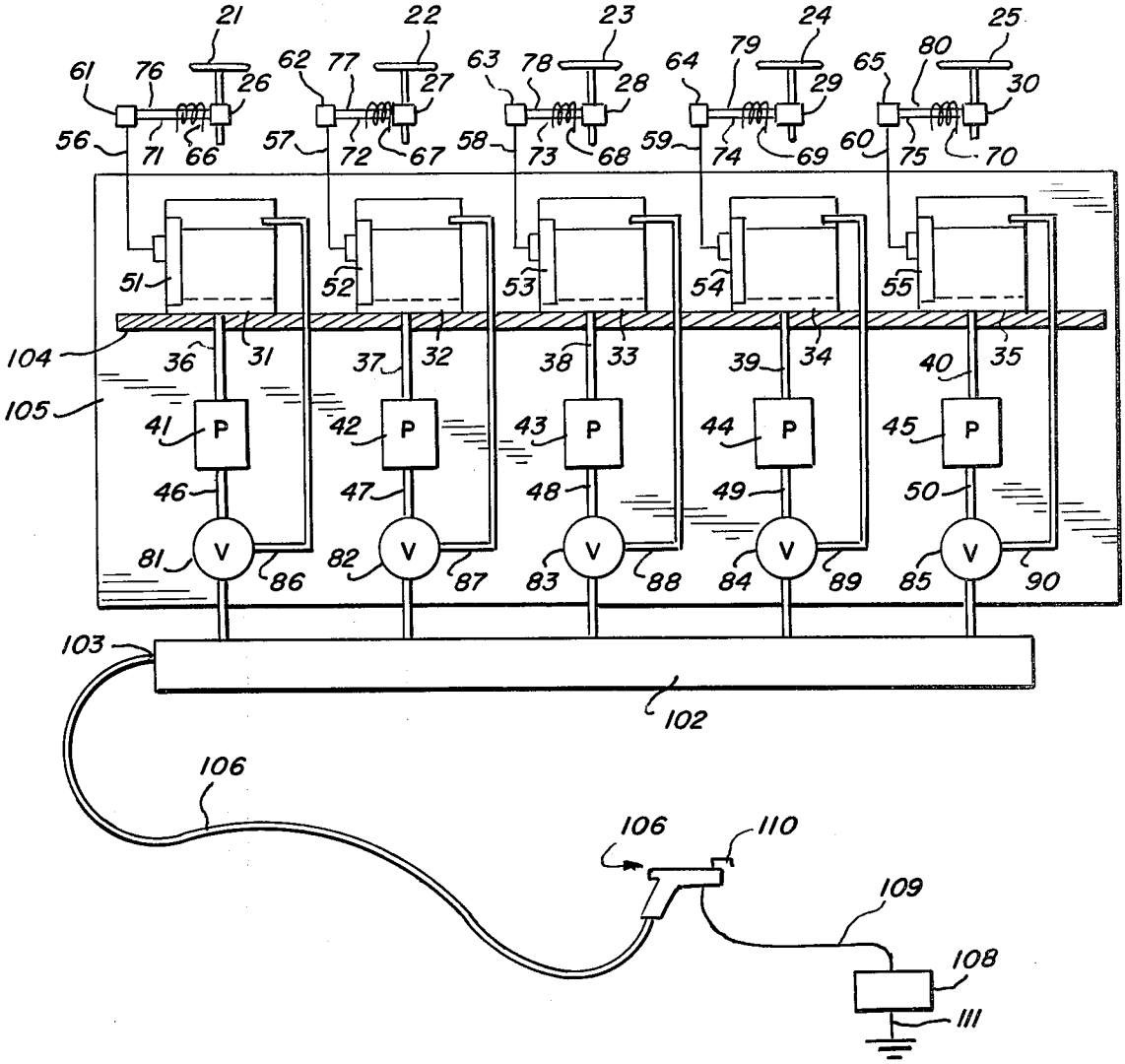
FIG. 2 is a front schematic type view of the embodiment of the invention illustrated in FIG. 1 taken along the line 2—2.

Referring now to FIG. 2 in addition to FIG. 1, each circulating lines 21–25 has a solenoid valve 26–30 connected thereto to remove paint from each circulating line by line pressure and/or the force of gravity when the respective valve is opened. A plastic paint cannister 31–35 is mounted below each respective solenoid valve 26–30. The valves 26–30 and the cannisters 31–35 are mounted adjacent a spray booth generally indicated at 100, which has a normal exhaust stack 101. The circulating lines 21–25 together with the valves 26–30, the paint supply containers 11–15, and pumps 16–20 comprise an electrically grounded paint sub-supply system. The cannisters 31–35, each of which is separated by an air space from the respective valve 26–30, together with the elements which will presently be described, form a high voltage coating material supply sub-system which receives coating material through the air space and delivers it to one or more electrostatic spray guns. The cannisters 31–35 have conduits 36–40 respective connected at their bottoms to be gravity fed. The conduits 36–40 are each connected to an intake port of a coating material pump 41–45, which may be of any conventional design well known in the art. A discharge port of each pump 41–45 is connected to a remote controlled three-way valve 81–85 respectively. The valves 81–85 are connected to a general supply manifold 102 having an output port 103.

Level sensing devices 51–55 are electrically connected by respective leads 56–60 to timers 61–65 respectively. The timers 61–65 are connected to actuating coils 66–70 of the solenoid valves 26–30 respectively by a pair of electrical leads 71–80 to alternatively energize and de-energize coils 66–70. Timers 61–65 provides activation signals of a predetermined length to coils 66–70 spaced by de-energization of the coils 66–70 for a predetermined length as long as the timers 61–65 are energized by signals from the respective sensing devices 51–55.

The level sensing devices 51–55 may be made of any conventional design well known to those skilled in the art which detects an upper or full level as indicated by the solid line on the cannister and a lower or refill level as indicated by the dashed lines in the cannisters 31–35. They may be of the float level switch type wherein a pair of electrical contacts are closed when the fluid in a cannister reaches the lower level to provide an energizing signal to the respective timers 61–65 until the upper level is reached, at which point the actuating signal is terminated. As a further example the two level sensing device which controls the respective timers can be of the weighing type wherein an electrical signal is set to a respective timer whenever the cannister becomes lighter than a predetermined low value and terminates said signals when the cannister reaches a heavier or predetermined full weight.

Each three-way valve 81–85 has a port connected by a respective return line 86–90 respectively to the respective cannisters 31–35.

The cannisters 31–35, pumps 41–45, valves 81–85, and the manifold 102 are mounted on an electrically insulating support structure generally indicated at 104. A plastic shield generally indicated at 105 surrounds the structure to prevent operator contact. The manifold 102 has a flexible fluid hose 106 connected either to one or more manual or automatic spray guns, such as 107. A high voltage power supply 108 is connected by a lead 109 to an electrode 110 on the gun 107.

The operation of the preferred embodiment of the invention illustrated in FIGS. 1 and 2 will now be described. Highly conductive coating material of four different colors are placed in paint containers 11–14 respectively. Container 15 is filled with a solvent. These containers are part of the grounded sub-supply system. They may be refilled at any time regardless of whether high voltage is being applied to the electrode 110 and thereby to highly conductive coating material in the gun 107, the flexible hose 106, and the manifold 102. The pumps 16–20 are then turned on, filling the electrically grounded coating material recirculating lines 21–25 respectively. When high voltage power supply 108 is energized, an actuation circuit for the timers 61–65 is also activated. The level sensing devices send electrical signals to start the timers 61–65. With timers 61–65 operating periodic activation of solenoid valves 26–30 are accomplished by the series of signals of predetermined length provided from the timers 61–65 respectively. Therefore valves 26–30 open long enough to emit a measured quantity of highly conductive coating material which transfers the air space to cannisters 31–35 by pressure and/or the force of gravity. The time between the actuation signals generated by timers 61–65 is of sufficient length that the space between the sequential measured masses of coating material from the valves 26–30 are sufficiently spaced that an arc will not traverse the air space through the coating material masses from the cannister or its contents, to the grounded valves 26–30. The sensing devices 51–55 electrically isolate their operating elements from the respective electrical leads 56–60 so that the high voltage material supply sub-system does not short to ground.

When the level of the coating material in any of the cannisters 31–35 reaches the upper predetermined level, respective level sensing device terminates its signal deactivating and stopping the respective timers 61–65. Since no actuation signals are now being sent from the timer to the respective solenoid coil, its valve remains closed. When the system is in operation the pumps 41–45 run continuously and the three-way valves 81–85 are set to return the output of the pumps to the respective cannisters 31–35 in order that there is a continual circulation of paint from the pump to the valve, to the cannister, and back to the pump.

The operator through the remote controls (not shown) turns on valve 81 filling the manifold 102 and the flexible hose 106 with the highly conductive coating material received from container 11. Spray gun 107 is now operated in the normal manner receiving highly conductive coating material through the flexible hose 106. Since the coating material as it is sprayed is in contact with electrode 110 the entire body of coating material contained in the gun 107, the hose 106, the manifold 102, valve 81, pump 41, and cannister 31, are all charged to high voltage. As the coating material in cannister 31 is used up the level will fall to the lower predetermined level and the level sensing device 51 will start timer 61 ejecting measured masses of conductive coating material sequentially from valve 26 under pressure and/or the force of gravity. If the pressure in the circulating lines is extremely low the force of gravity may be a significant factor in the size of the sequential masses of coating material relative to the time the valve is open. As the operating pressure is increased, the pressure provided by the respective pumps 16–20 will be the significant factor in the time the valve is open to eject each mass. The pumps 41–45 could be energized only when their respective valves are open to manifold 102, but it has been found desirable to continually recirculate coating material by such recirculating methods.

When it is desirable to change to another color, valve 51 is closed to manifold 102 and valve 55 is opened to allow solvent to enter the manifold 102, the hose 106, and the gun 107. After the solvent has cleared the coating material from these elements, valve 55 is closed and another valve is opened to manifold 102 to provide a new color for spraying the next group of work. Thus there is a continual flow of coating material of any given selected color without turning off the high voltage. Further colors can be varied and solvents may be utilized to flush the high voltage supply sub-system without turning off the high voltage power supply.

Figure 3:
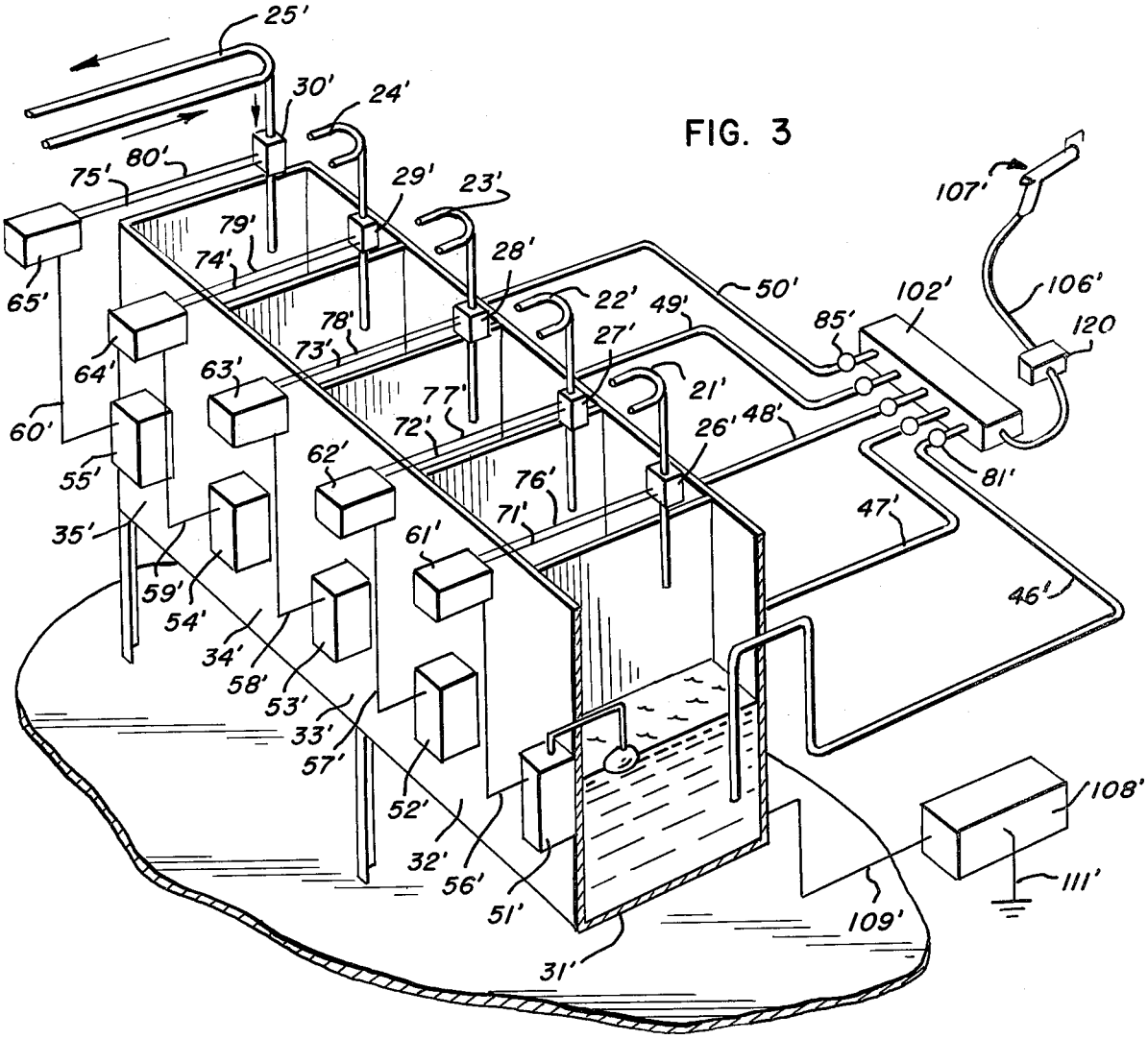
FIG. 3 is a perspective schematic view of a modified embodiment of the invention illustrated in FIGS. 1 and 2.

Referring now to FIG. 3 a modified form of the invention illustrated in FIGS. 1 and 2 utilizes a single pump in the high voltage sub-system and eliminates the individual cannisters recirculating system. While this modification is relatively economical in original construction and its use of electrical power for the pumps, it does have the relative disadvantage of lacking continuous recirculation through the valves. The portion of the grounded sub-system which is not shown is similar to that illustrated in FIG. 1. Similar elements to those illustrated in FIGS. 1 and 2 which perform the same functions are identified by the same number prime (').

Grounded recirculating lines 21'-25' are connected to solenoid valves 26'-30' and operating in the same manner as its corresponding components illustrated in FIG. 1. A set of tanks 31'-35' perform the same functions as the cannisters 31-35 in receiving masses of coating material ejected from the valves 26'-30' by the circulating line pressure aided the force of gravity. A set of level sensing devices 51'-55', a set of electrical leads 56'-60', a set of timers 61'-65' and electrical leads 71'-81' are connected and operate in the same manner as the corresponding elements in FIGS. 1 and 2. The tanks 31'-35' are connected directly to a set of valves 81'-85' which are gravity fed by a set of conduits 46'-50'. Instead of having the pumps between the tanks or cannisters and the manifold valves in the high voltage sub-system, the tanks are connected directly to the valves and a single pump 120 is connected to the discharge of valves 81'-85' as illustrated in FIGS. 1 and 2. Thus when one of the valves 81'-85' is opened, material will flow from one of the tanks 31'-35' into the manifold 102', which, being connected to the suction side of pump 120, will have coating material transferred through the flexible conduit 106' to the gun 107'. The gun 107' like the gun 107 may be of the film electrode type described in detail in U.S. Pat. No. 3,774,844 issued Nov. 27, 1973, or described in U.S. Pat. No. 3,746,253 issued July 17, 1973. In addition it may be of any one of the types commonly known in the art which has a metal electrode. If the gun is a manual gun rather than an automatic electrostatic spray gun, then the gun and the connecting cables should be of the protective construction fully described in the two aforementioned U.S. Patents. A high voltage power supply 108' is connected to ground by a lead 111' and has its high voltage terminal connected by a lead 109' directly to the highly conductive coating material in the tanks 31'-35'. The high voltage is then carried to the electrode, whether it be the atomizing fluid edge or a separate metallic electrode through the coating material flowing through the valves 81'-85', the manifold 102', and the flexible conduit 106'.

The valves 81'-85' are actuated by remote control (not shown), which may be of any conventional mechanical or electrical design, to select a particular color or a washing solvent as before described without the necessity of securing the high voltage system. It will be understood by those skilled in the art that various combinations of automatic or manual electrostatic spray guns, various combinations of protective flexible conduit and various points of connection of the high voltage power supply may be made in the high voltage supply sub-system without departing from the scope of the present invention.

Many other modifications may be made by those skilled in the art without departing from the basic invention disclosed herein. For example, the solenoid valve 26 could be replaced by a pump which delivers measured quantities of coating material through an output port and timer 61 could be replaced by a clock which merely issues spaced signals to the measuring pump. Under such circumstances, each measured mass of coating material will be propelled under pressure and may be propelled not only vertically, but horizontally, or at any angle therebetween through the air space to the receiving cannister.

I claim:

1. In an electrostatic coating system having a spray gun for ejecting highly electrically conductive coating material and an electrode charged to high voltage adjacent the location of ejection of the coating material from the spray gun having a high voltage power supply, and having a coating material supply system supplying coating material to the gun, wherein the improvement comprises, a first sub-system in said coating material supply system containing coating material electrically grounded, a second sub-system in said coating material supply system containing coating material insulated from electrical ground and connected to said high voltage power supply, means for periodically ejecting predetermined masses of coating material into the atmosphere forming a portion of said first sub-system, and means forming a portion of said second sub-system for periodically receiving said predetermined masses of coating material ejected across a predetermined air space, said air space having a sufficiently large predetermined dimension between said first and second means and said masses of coating material being of a relatively small predetermined size to prevent arcing in said air space when said second system is charged to a high voltage by said high voltage power supply.

2. An electrostatic coating system as specified in claim 1, wherein said receiving means is positioned under said ejecting means and said ejecting means comprises a valve.

3. An electrostatic coating system as specified in claim 1, wherein said receiving means is positioned under said ejecting means and said ejecting means comprises, a valve, and timing means connected to said valve to alternatively open said valve for one predetermined period of time and close said valve for another predetermined period of time.

4. An electrostatic coating system as specified in claim 1, wherein said receiving means is positioned under said ejecting means and said ejecting means comprises, a valve, timing means connected to said valve to alternatively open said valve for one predetermined period of time and close said valve for another predetermined period of time, sensing means connected to said second supply means to determine when the coating material in said second sub-system falls below a predetermined level, and means for activating said timing means connected to said sensing means and to said timing means.

5. An electrostatic coating system as specified in claim 1, wherein said ejecting means is a pump delivering a measured quantity of coating material in response to a signal impulse and having a discharge part into said air space.

6. An electrostatic coating system as specified in claim 1, wherein said ejecting means comprises, a pump delivering a measured quantity of coating material in response to a signal impulse and having a discharge into said air space, and clock means connected to deliver timed actuating impulses to said pump.

7. An electrostatic coating system as specified in claim 1, wherein said ejecting means comprises, a pump delivering a measured quantity of coating material in response to a signal impulse and having a discharge into said air space, clock means connected to deliver timed actuating impulses to said pump, sensing means connected to said second supply means to determine when the coating material in said second sub-system falls below a predetermined level for activating said clock means.

8. An electrostatic coating system having a spray gun for ejecting a highly electrically conductive coating material and an elecrode charged to high voltage adjacent the location of ejection of the coating material from the spray gun having a high voltage power supply and having a coating material supply system applying coating material to the gun, wherein the improvement comprises, a first sub-system in said coating material supply system containing a multiplicity of coating materials electrically grounded, a second sub-system in said coating material supply system containing the same multiplicity of coating materials insulated from electrical ground and connected to said high voltage power supply, means for periodically ejecting predetermined masses of coating materials into the atmosphere forming a portion of said first sub-system, and means forming a portion of said second sub-system for periodically receiving said predetermined masses of coating materials as they are ejected across said air space having a sufficiently large predetermined dimension between said first and second means and said masses of coating material being of a relatively small predetermined size to prevent arcing in said air space when said second system is charged to a high voltage by said high voltage power supply.

9. An electrostatic coating system as specified in claim 8, wherein said receiving means includes a manifold connected to a center valve whereby any of said multiplicity of coating materials may be selected for transfer to a flexible spray gun supply hose.

* * * * *